US012782032B2

(12) United States Patent
Tharp et al.

(10) Patent No.: US 12,782,032 B2
(45) Date of Patent: Nov. 3, 2026

(54) COLD SUPPLY CHAIN PACKAGING COMPONENTS AND METHODS OF TRANSPORTING GOODS

(71) Applicant: Packaging Systems Cold Chain LLC, Carmel, IN (US)

(72) Inventors: Pat Tharp, Carmel, IN (US); Kasey Clevenger, Carmel, IN (US)

(73) Assignee: Packaging Systems Cold Chain LLC, Carmel, IN (US)

( * ) Notice: Subject to any disclaimer, the term of this patent is extended or adjusted under 35 U.S.C. 154(b) by 362 days.

(21) Appl. No.: 18/332,172

(22) Filed: Jun. 9, 2023

(65) Prior Publication Data

US 2023/0408163 A1 Dec. 21, 2023

Related U.S. Application Data

(60) Provisional application No. 63/350,535, filed on Jun. 9, 2022.

(51) Int. Cl.
*F25D 3/08* (2006.01)

(52) U.S. Cl.
CPC ..... *F25D 3/08* (2013.01); *F25D 2303/0822* (2013.01); *F25D 2303/085* (2013.01)

(58) Field of Classification Search
CPC ..... F25D 3/08; F25D 2303/0822; F25D 2303/085
See application file for complete search history.

(56) References Cited

U.S. PATENT DOCUMENTS 4,081,256 A 3/1978 Donnelly
6,099,555 A 8/2000 Sabin
6,453,683 B1 9/2002 Wisniewski et al.
D665,430 S 8/2012 Sorensen
D702,847 S 4/2014 Arsenault et al.
D726,928 S 4/2015 Suzuki et al.
9,039,924 B2 5/2015 Leavitt et al.
9,366,483 B2 6/2016 Eckhoff et al.
10,155,698 B2 12/2018 Leavitt et al.
D851,776 S 6/2019 Weinstein
10,378,810 B2 8/2019 Na et al.
(Continued)

FOREIGN PATENT DOCUMENTS

CN 102245218 A * 11/2011 ..... A61L 15/28
CN 110769689 A * 2/2020 ..... A01N 1/162
(Continued)

OTHER PUBLICATIONS

CN 102245218 A Translation (Year: 2011).*
(Continued)

*Primary Examiner* — Jerry-Daryl Fletcher
*Assistant Examiner* — Dario Antonio Deleon
(74) *Attorney, Agent, or Firm* — MacMillan, Sobanski & Todd, LLC

(57) ABSTRACT

A cold pack comprises a main body; an inner chamber defined by the main body; and a phase changeable medium disposed in the inner chamber. The phase changeable medium includes a polymer and a peptide, which can be a component of a peptide-containing composition. In specific examples, the polymer is an organic polymer, such as an organic superabsorbent polymer, and the peptide is a lateral root hair promoting peptide.

17 Claims, 6 Drawing Sheets

Specification includes a Sequence Listing.

(56) References Cited

U.S. PATENT DOCUMENTS

| | | | | |
|---|---|---|---|---|
| 10,487,252 | B2 | 11/2019 | Schweke et al. | |
| D872,292 | S | 1/2020 | Liebman | |
| 10,557,659 | B2 | 2/2020 | Leavitt et al. | |
| 10,948,221 | B1 | 3/2021 | Bergida et al. | |
| 11,009,280 | B1 | 5/2021 | Bergida et al. | |
| D922,594 | S | 6/2021 | Akiyama | |
| 11,046,735 | B2 * | 6/2021 | Thompson et al. | C12N 1/20 |
| 2005/0011202 | A1 | 1/2005 | Voute et al. | |
| 2015/0197679 | A1 * | 7/2015 | Gu | C09K 5/066 252/79 |
| 2019/0269548 | A1 * | 9/2019 | Fan et al. | C08L 33/02 |
| 2020/0131096 | A1 * | 4/2020 | Li et al. | C05F 17/20 |
| 2020/0247096 | A1 | 8/2020 | Woodbridge et al. | |
| 2020/0255851 | A1 | 8/2020 | Thompson et al. | |
| 2021/0025660 | A1 | 1/2021 | Bergida et al. | |
| 2021/0163806 | A1 | 6/2021 | Bergida et al. | |

FOREIGN PATENT DOCUMENTS

| | | | | |
|---|---|---|---|---|
| CN | 111012691 | A | 4/2020 | |
| CN | 112353999 | A | 2/2021 | |
| KR | 200386926 | Y1 * | 6/2005 | B65D 81/18 |
| WO | WO 9929800 | A1 * | 6/1999 | C09K 5/066 |
| WO | WO 2007103917 | A2 * | 9/2007 | F25D 2331/809 |
| WO | 2018174829 | A1 | 9/2018 | |

OTHER PUBLICATIONS

WO 2007103917 A2 Translation (Year: 2007).*
KR 200386926 Y1 Translation (Year: 2003).*
WO 9929800 A1 Translation (Year: 1999).*
CN 110769689 A Translation (Year: 2020).*
PCT International Search Report and Written Opinion, Application No. PCT/US2023/068175, dated Sep. 29, 2023.

* cited by examiner

COLD SUPPLY CHAIN PACKAGING COMPONENTS AND METHODS OF TRANSPORTING GOODS

CROSS-REFERENCE TO RELATED APPLICATION

This application claims priority to U.S. Provisional Application No. 63/350,535, filed Jun. 9, 2022. The entire contents of this related application is hereby incorporated by reference into this disclosure.

REFERENCE TO SEQUENCE LISTING

This application contains a Sequence Listing which has been submitted electronically via USPTO Patent Center as an XML file. The Sequence Listing is part of the specification and is hereby incorporated by reference in its entirety. The XML file has file name of "63247-US-ST26.xml", a creation date of Jun. 8, 2023, and is 1,935 bytes in size.

FIELD

The disclosure relates to cold supply chain packaging components. More particularly, the disclosure relates to cold packs useful for providing non-mechanical refrigeration for maintaining a temperature range during the transport of various goods, such as foods, medical products, and other goods. Specific embodiments described herein relate to cold packs that include a phase changeable medium comprising a protein-based component, such as a lateral root hair promoting peptide. The disclosure also relates to methods of transporting goods.

BACKGROUND

Cold packs, sometimes referred to as ice packs or gel packs, are portable containers filled with a phase changeable medium, such as water, refrigerant gel, or other types of liquids. The phase changeable medium, once frozen, is capable of absorbing a certain amount of ambient heat while returning to a neutral or non-frozen state. Frozen cold packs can be placed adjacent to goods to maintain their temperature within a range by absorbing ambient heat as the phase changeable medium returns back to a non-frozen state. Cold packs, therefore, provide reliable, non-mechanical refrigeration that can be used to maintain goods in a temperature range during transport. As such, cold packs are commonly used in the transport of a variety of goods, including foods, pharmaceuticals, biological products, and other types of goods for which maintenance of temperature is desirable or critical.

Unfortunately, the pervasive use of cold packs in cold supply chain packaging and transportation has an environmental impact. Cold packs are typically discarded before their useful life is exhausted. Furthermore, conventional cold packs lack any secondary use, which can increase the desire by users to prematurely discard them.

A need exists, therefore, for improved cold packs and improved methods of transporting goods.

BRIEF SUMMARY OF SELECTED EXAMPLES

Various example cold packs are described.

An example cold pack comprises a main body defining an inner chamber and a phase changeable medium disposed in the inner chamber. The phase changeable medium comprises a plant-derived protein hydrolysate. In some examples, the phase changeable medium comprises an organic polymer and a peptide disposed in the organic polymer. In some examples, the peptide comprises a lateral root hair promoting peptide.

Another example cold pack comprises a main body comprising an outer layer, an inner layer defining an inner chamber, and a phase changeable medium disposed in the inner chamber. The phase changeable medium comprises a plant-derived protein hydrolysate. In some examples, the phase changeable medium comprises an organic polymer and a peptide disposed in the organic polymer. In some examples, the peptide comprises a lateral root hair promoting peptide. In some examples, the outer layer comprises a non-polymeric material and the inner layer comprises a polymeric material. In some examples, the outer layer comprises a paper material and the inner layer comprises a polymeric material.

Another example cold pack comprises a multi-layer main body defining an inner chamber and a phase changeable medium disposed in the inner chamber. The main body comprises an outer non-polymeric layer and an inner polymeric layer that defines the inner chamber. The phase changeable medium comprises a plant-derived protein hydrolysate. In some examples, the phase changeable medium comprises an organic polymer and a peptide disposed in the organic polymer. In some examples, the peptide comprises a lateral root hair promoting peptide.

Another example cold pack comprises a main body defining an inner chamber; an opening formed on the main body and in fluid communication with the inner chamber; a cap adapted to selectively seal and unseal the opening; and a phase changeable medium disposed in the inner chamber. The phase changeable medium comprises a plant-derived protein hydrolysate. In some examples, the phase changeable medium comprises an organic polymer and a peptide disposed in the organic polymer. In some examples, the peptide comprises a lateral root hair promoting peptide.

Another example cold pack comprises a main body formed from polyethylene film and having a first outer surface, a second outer surface, a first edge, a second edge, a third edge, a fourth edge, and an intermediate seam, the first outer surface connected to the second outer surface by at least the first edge and the second edge. The main body has an inner surface that defines an inner chamber. A phase changeable medium is disposed in the inner chamber. The phase changeable medium comprises an organic polymer and a plant-derived protein hydrolysate. In some examples, the phase changeable medium comprises an organic polymer and a peptide. In some examples, the phase changeable medium comprises an organic polymer and a lateral root hair promoting peptide.

Another example cold pack comprises a main body comprising a first layer and a second layer. The first layer defines a first outer surface, a second outer surface continuous with the first outer surface, a first edge disposed between the first outer surface and the second outer surface, and a second edge disposed between the first outer surface and the second outer surface. The second layer defines an inner surface that defines an inner chamber. A phase changeable medium is disposed in the inner chamber. The phase changeable medium comprises an organic polymer and a plant-derived protein hydrolysate. In some examples, the phase changeable medium comprises an organic polymer and a peptide. In some examples, the phase changeable medium comprises an organic polymer and a lateral root hair promoting peptide. In some examples, the first layer comprises a non-polymeric material. In some examples, the second layer comprises a polymeric material.

Another example cold pack comprises a main body comprising a first layer comprising a paper material and a second layer comprising a polymeric material. The first layer defines a first outer surface, a second outer surface continuous with the first outer surface, a first edge disposed between the first outer surface and the second outer surface, and a second edge disposed between the first outer surface and the second outer surface. The second layer defines an inner surface that defines an inner chamber. A phase changeable medium is disposed in the inner chamber. The phase changeable medium comprises an organic polymer and a plant-derived protein hydrolysate. In some examples, the phase changeable medium comprises an organic polymer and a peptide. In some examples, the phase changeable medium comprises an organic polymer and a lateral root hair promoting peptide.

Various example methods of delivering goods are also described.

An example method of delivering goods comprises placing a good in a chamber defined by a container; placing a cold pack in the chamber, the cold pack comprising a main body defining an inner chamber and a phase changeable medium disposed in the inner chamber, the phase changeable medium comprising a peptide; closing the container to contain the good and the cold pack in the chamber defined by the container; and transporting the container from a first location to a second location that is different from the first location.

Another example method of delivering goods comprises placing a good in a chamber defined by a container; placing a cold pack in the chamber, the cold pack comprising a main body defining an inner chamber and a phase changeable medium disposed in the inner chamber, the phase changeable medium comprising a lateral root hair promoting peptide; closing the container to contain the good and the cold pack in the chamber defined by the container; and transporting the container from a first location to a second location that is different from the first location.

Another example method of delivering goods comprises placing a good in a chamber defined by a container; placing a cold pack in the chamber, the cold pack comprising a main body defining an outer layer and an inner layer defining an inner chamber, a phase changeable medium disposed in the inner chamber, the phase changeable medium comprises a lateral root hair promoting peptide; closing the container to contain the good and the cold pack in the chamber defined by the container; and transporting the container from a first location to a second location that is different from the first location.

Additional understanding of the inventive cold packs and methods of delivering goods can be obtained by reviewing the detailed description of selected examples, below, the referenced drawings, and the Sequence Listing.

DETAILED DESCRIPTION OF SELECTED EXAMPLES

The following detailed description and the appended drawings describe and illustrate various example cold packs and methods of delivering goods. The description and illustration of these examples enable one skilled in the art to make and use examples of the inventive cold packs and to perform the inventive methods of delivering goods. They do not limit the scope of the claims in any manner.

Figure 1:
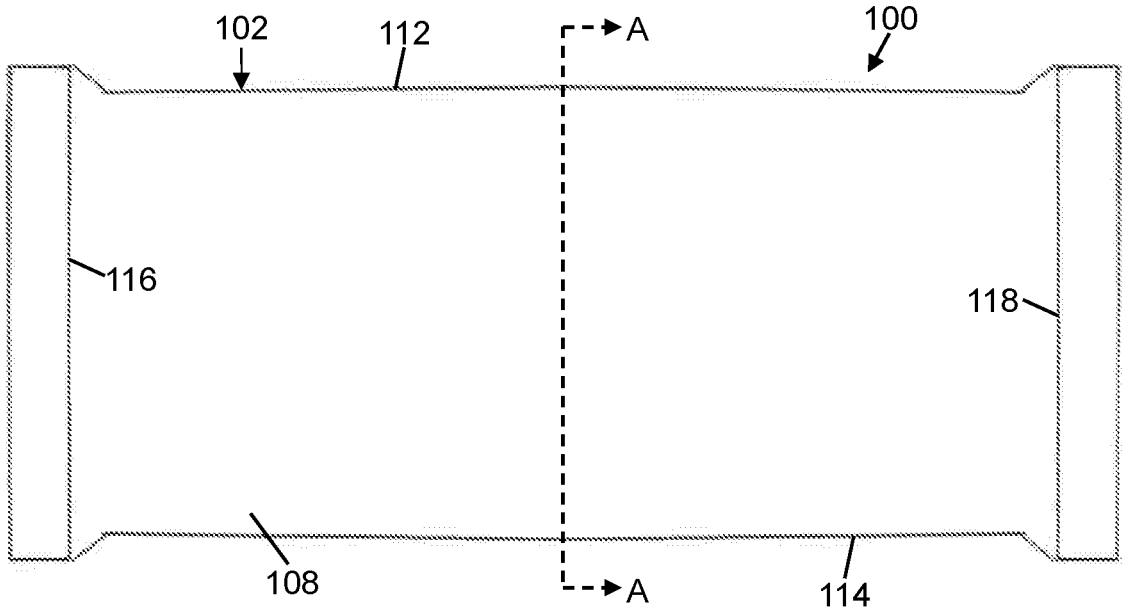
FIG. 1 is a top plan view of an example cold pack.
Figure 2:
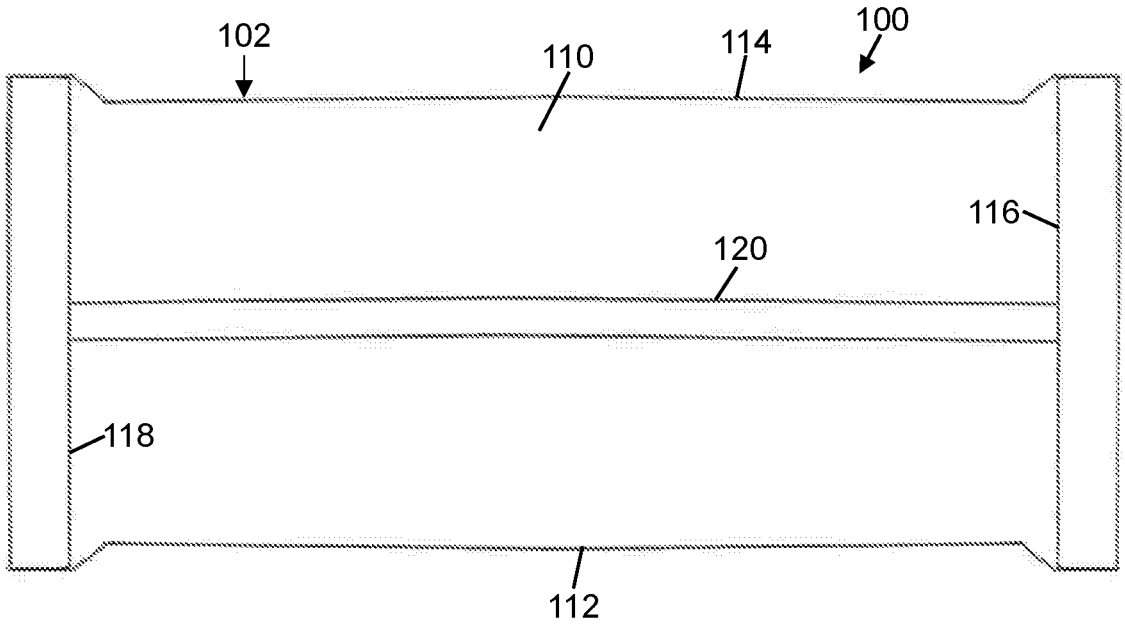
FIG. 2 is a bottom plan view of the cold pack illustrated in FIG. 1.
Figure 3:
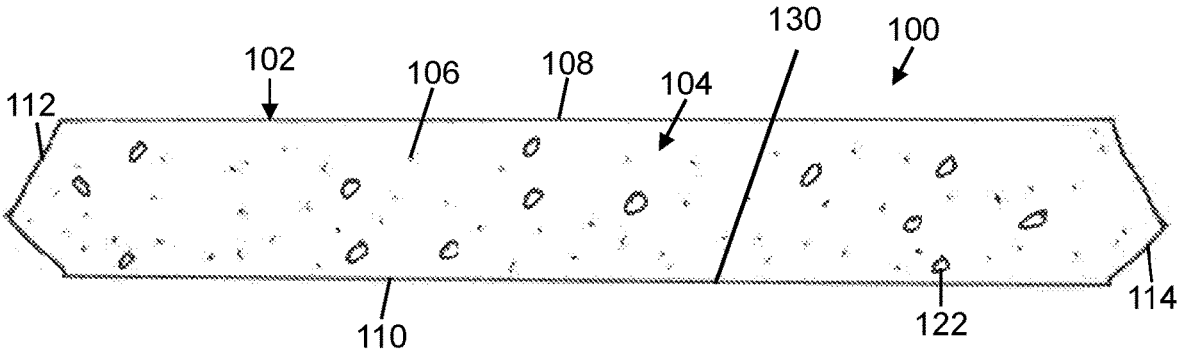
FIG. 3 is a sectional view of the cold pack illustrated in FIG. 1 taken along section line A-A in FIG. 1. The phase changeable medium and the lateral root hair promoting peptide is illustrated in the inner chamber.

Each of FIGS. 1, 2, and 3, illustrate a first example cold pack 100. The cold pack 100 has a main body 102 defining an inner chamber 104, and a phase changeable medium 106 disposed in the inner chamber 104. In the illustrated example, the main body 102 has a first outer surface 108, a second outer surface 110, a first edge 112, a second edge 114, a third edge 116, and a fourth edge 118, and an intermediate seam 120. The first outer surface 108 is disposed opposite the second outer surface 110. The first outer surface 108 is connected to the second outer surface 110 by the first edge 112, the second edge 114, the third edge 116, the fourth edge 118, and the intermediate seam 120. The intermediate seam 120 is formed on the second outer surface 110. The first outer surface 108, the second outer surface 110, the first edge 112, the second edge 114, the third edge 116, the fourth edge 118, and the intermediate seam 120 cooperatively form inner surface 130 which defines the boundary of the inner chamber 104.

In certain examples, the first outer surface 108 and the second outer surface 110 are formed from one sheet of material. The sheet of material is folded along the first edge 112 and the second edge 114. The sheet of material is sealed along the third edge 116, the fourth edge 118 and the intermediate seam 120 to form the main body 102. This may be accomplished using heat and pressure. However, other methods can also be utilized to seal the third edge 116, the fourth edge 118 and the intermediate seal. Different configurations can also be employed to form the main body 102 such as using multiple sheets of material, sealing more or less edges, and folding more or less edges.

In certain examples, the main body 102 is formed from materials, such as plastic film, which enable the main body 102 to be flexible at room temperature. The flexibility of the main body 102 allows the main body 102 to bend and conform in shape, which is beneficial in chilling objects with irregular shapes. In alternative embodiments, the main body 102 is formed from a material, such as a rigid plastic, to militate against the main body 102 from bending or conforming in shape and to improve durability. This can be beneficial in circumstances where the main body 102 will be reused instead of being completely disassemble or recycled.

In certain examples, it is considered advantageous to use materials that are biodegradable, recyclable, or compostable at least because these types of materials can facilitate recycling and disassembling the cold pack 100 with less environmental consequences when compared to more harmful materials. Examples of materials considered suitable for use in the main body 102 of a cold pack 100 according to an embodiment include, but are not limited to, biodegradable paper, recyclable plastic, plant-based materials, or combinations thereof. In certain embodiments, the main body is formed of a polyethylene, such as a polyethylene film. Advantageously, polyethylene is widely available, recyclable, lightweight, durable, and can be formed into thin plastic film. An example of a suitable polyethylene film is AmPrima PE Plus recycle ready pouching film available from Amcor Flexibles North America (Oshkosh, WI). The AmPrima PE Plus polyethylene film is considered advantageous at least because of its flexibility, its desirable moisture and oxygen barrier properties, and its readiness for curbside and in-store recycling. In certain examples, the main body comprises a multi-component structure, such as a multi-layered structure. For example, in particular embodiments, the main body comprises a first layer comprising a paper and a second layer comprising a barrier, such as a polymer film or other polymeric layer. Inclusion of a main body having this structural and compositional arrangement is considered particularly advantageous at least because it provides a flexible main body that is recyclable and suitable for retaining the phase changeable medium in the inner chamber of a cold pack having the main body. Examples of suitable paper materials for inclusion in a main body of a cold pack according to an embodiment include, but are not limited to, paper materials described in United States Patent Application Publication No. 2021/0060888, the contents of which are incorporated into this disclosure in their entirety. Preferably, paper material used in a main body for a cold pack according to an embodiment is suitable for use on form fill seal equipment known in the packaging arts.

As illustrated in FIG. 3, the inner chamber 104 is defined by the main body 102. The inner chamber 104 functions as a reservoir for the phase changeable medium 106. The size of the inner chamber 104 and the main body 102 can be changed according to the end use of the cold pack 100. For example, the main body 102 can have a length from about 4 inches to about 20 inches and a width from about 4 inches to about 20 inches. However, a skilled artisan can scale the dimensions of the main body 102 and the inner chamber 104 based on various considerations, such as the size of the object to be chilled and how long the temperature of the object needs to be maintained.

The phase changeable medium 106 is disposed in the inner chamber 104. When the cold pack 100 is subject to a sufficient cold temperature, the phase changeable medium 106 freezes. Once frozen, the phase changeable medium 106 absorbs ambient heat as the phase changeable medium 106 warms to a neutral state, e.g., room temperature. Thus, the phase changeable medium 106, when frozen, can be used to chill objects when the objects are placed adjacent to the cold pack 100. Non-limiting examples of the phase changeable medium 106 includes substances capable of being a liquid or a gel at room temperature.

The phase changeable medium 106 advantageously comprises a polymer. Organic polymers, including organic superabsorbent polymers, are considered particularly advantageous at least because of their organic nature and their ability to absorb and retain large amounts of liquid relative to their own mass. The inventors have determined that potassium polyacrylate, an organic superabsorbent polymer, is advantageous, particularly when the phase changeable medium 106 comprises a peptide or other peptide-containing composition, as described in detail below.

The phase changeable medium 106 advantageously comprises a peptide, which can be a component of a peptide-containing composition. Peptides and peptide-containing compositions that are beneficial to plants are considered particularly advantageous, at least because they confer a secondary use on the cold packs. Specifically, inclusion of a peptide or a peptide-containing composition in the phase changeable medium 106 enables a user of the cold pack, or another individual, to apply the phase changeable medium onto a plant or other vegetation to confer any benefits provided to the plant or other vegetation by the peptide or peptide-containing composition.

In some embodiments, the phase changeable medium 106 includes a plant-derived protein hydrolysate, such as a legume-derived protein hydrolysate. In some examples, the phase changeable medium comprises a peptide. In some examples, the phase changeable medium comprises a lateral root hair promoting peptide.

Peptides originating from the Kunitz soybean trypsin inhibitor from soybeans have been found to facilitate root hair growth and root formation in vegetation. These peptides are separated and purified, and then degraded by an alkaline protease. The degraded products of the Kunitz soybean trypsin inhibitor purified from whey protein exhibit high root hair promoting activity. Specifically, positions 27-38 in the Kunitz soybean trypsin inhibitor, set forth in SEQ ID NO. 1, have been designated as the lateral root hair promoting peptide 122. The lateral root hair promoting peptide 122, set forth in SEQ ID NO. 1, consists of 12 amino acids and is rich in Ala, Arg, and Gly residues, containing at least two of each of these amino acids. The lateral root hair promoting peptide 122, set forth in SEQ ID NO. 1, contains four residues of α-helix breaking amino acids. It has been observed that the root hair promoting activity was retained after heat treatment (121° C., for 15 minutes). Thus, it is believed that the secondary and tertiary structures of the lateral root hair promoting peptide 122 are not required for its promotion of root hair growth and root formation in vegetation. In addition, it has been observed that the root hair promoting activity of the lateral root hair promoting peptide 122 decreased when one residue of the C terminus was deleted, which may indicate that the 12 residues of lateral root hair promoting peptide is the minimum unit for expressing root hair promoting activity. Further details regarding the lateral root hair promoting peptide 122 are described in Yoshiki Matsumiya and Motoki Kubo (2011), Soybean Peptide: Novel Plant Growth Promoting Peptide from Soybean, Soybean and Nutrition, Prof. Hany El-Sherry (Ed.), ISBN: 978-953-307-536-5, InTech, the entire disclosure of which, except for any definitions, disclaimers, disavowals, and inconsistencies, is incorporated herein by reference.

Lateral root hair promoting peptide 122 is considered particularly advantageous for inclusion in the phase changeable medium of a cold pack according to an embodiment at least because it enables beneficial secondary use of the cold packs, such as for promoting root formation in vegetation, which allows users of cold packs according to embodiments to discard the phase changeable medium on vegetation. Advantageously, the inclusion of the lateral root hair promoting peptide 122 in the inner chamber 104 enables use of the phase changeable medium 106 as a fertilizer when the cold pack 100 is recycled or disassembled, which provides an environmentally productive downstream use of an item that would otherwise be discarded. For example, a user can puncture the main body 102 to dispense the phase changeable medium 106 onto vegetation when the cold pack 100 is recycled or disassembled.

In certain embodiments, the phase changeable medium 106 also includes potassium polyacrylate. For example, the phase changeable medium 106 can be a gel formed from an organic polymer, such as the organic superabsorbent polymer potassium polyacrylate. The potassium polyacrylate facilitates macro-nutrient growth in the vegetation. Unlike sodium polyacrylate, the potassium polyacrylate militates against the risk of soil salinization. In addition, the potassium ions of the potassium polyacrylate can fertilize soil after decomposition. Advantageously, this further facilitates the phase changeable medium 106 to be reused to as a fertilizer when the cold pack 100 is recycled or disassembled. A skilled artisan may employ different types of gel, as long as they facilitate the phase changeable medium 106 to be used as a fertilizer for the vegetation.

Figure 4:
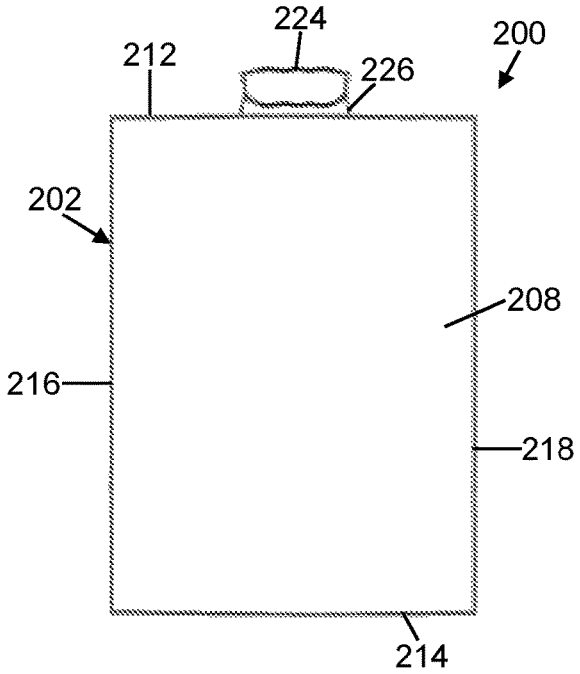
FIG. 4 is a front elevational view of another example cold pack.
Figure 5:
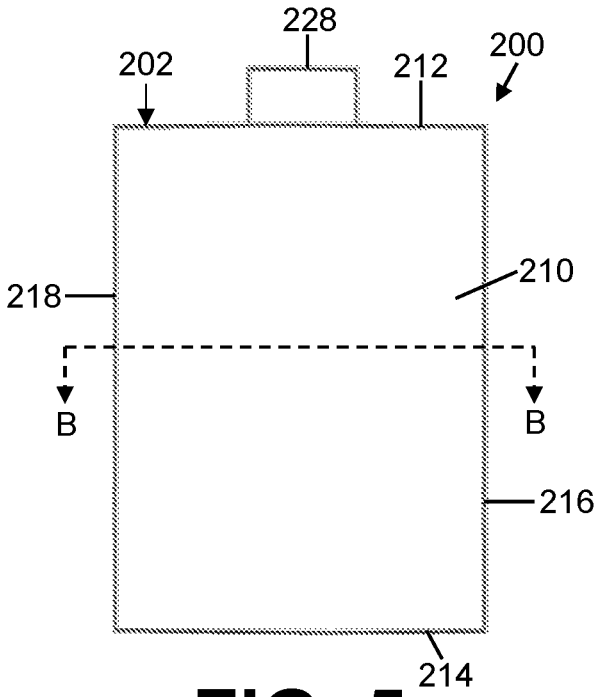
FIG. 5 is a rear elevational view of the cold pack illustrated in FIG. 4. A cap is disposed over the opening.
Figure 6:
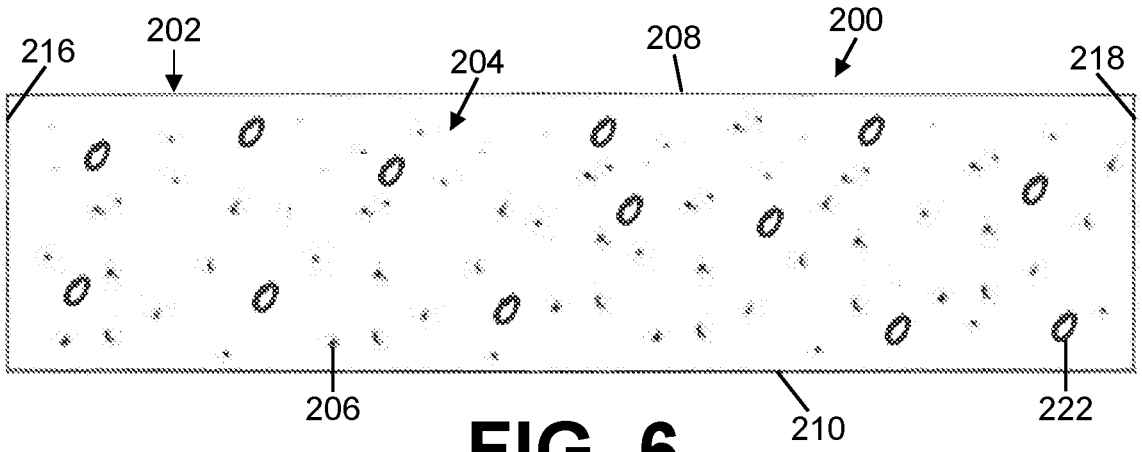
FIG. 6 is a sectional view of the cold pack illustrated in FIG. 5 taken along section line B-B in FIG. 5. The phase changeable medium and the lateral root hair promoting peptide is illustrated in the inner chamber.

FIGS. 4, 5, and 6, illustrates another example cold pack 200. The cold pack 200 is similar to the cold pack 100, except as described below. Thus, the cold pack 200 has a main body 202, an inner chamber 204 defined by the main body 202, and a phase changeable medium 206 disposed in the inner chamber 204. The phase changeable medium 206 includes the lateral root hair promoting peptide 222. In the illustrated example, the main body 202 has a first outer surface 208, a second outer surface 210, a first edge 212, a second edge 214, a third edge 216, and a fourth edge 218.

In this embodiment, the main body 202 defines an opening 224 on the main body 202. The opening 224 is in fluid communication with the inner chamber 204. The opening 224 enables for the phase changeable medium 206 to be disposed on the vegetation from the inner chamber 204 for fertilizing the vegetation. The opening 224 also facilitates refilling the inner chamber 204 with the phase changeable medium 206, if desired. In certain examples, the main body 202 includes a spout 226 and a cap 228. The spout 226 is formed on the main body 202 and defines the opening 224. The cap 228 can be used to selectively seal and unseal the opening 224 on the spout 226.

When the opening 224 is unsealed, a user can conveniently dispose the phase changeable medium 206 onto vegetation via the opening 224. Desirably, this allows the cold pack 200 to be emptied, while preserving the main body 202 for future use. When the opening 224 is sealed, the phase changeable medium 206 can be retained in the inner chamber 204. Other methods and mechanisms for opening 224 and closing the opening 224 may also be employed. Non-limiting examples of methods and mechanisms include zipper mechanism, snapping mechanisms, etc. In this embodiment, the main body 202 can be formed from more rigid and durable material since the opening 224 allows for the main body 202 to be reused after using the phase changeable medium 206 as fertilizer.

Advantageously, each of the cold packs 100, 200 allow for the fertilization of vegetation when the cold packs 100, 200 are recycled or disassembled. The phase changeable medium 106, 206 having the lateral root hair promoting peptide 122, 222 facilitates root hair growth and root formation in vegetation, which provides an environmentally productive downstream use of an item that would otherwise be discarded.

Figure 7:
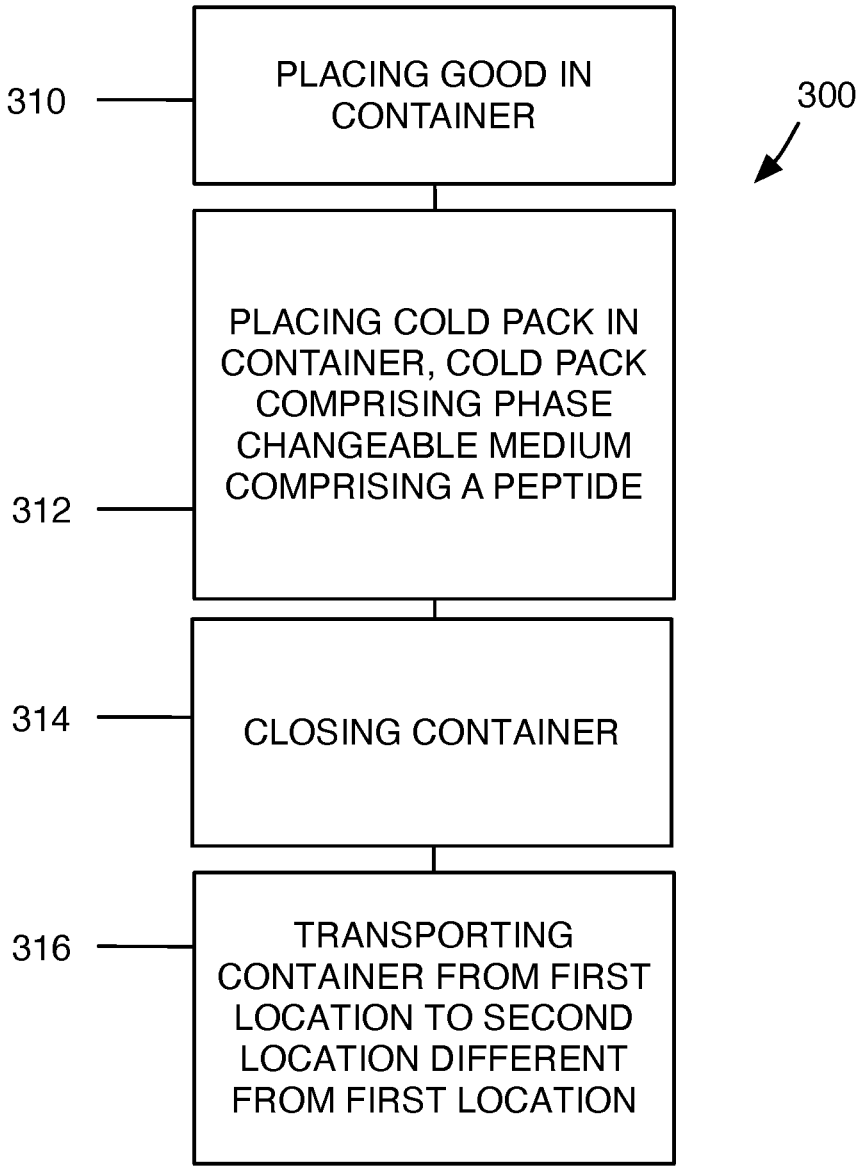
FIG. 7 is a flowchart illustration of an example method of delivering goods.

FIG. 7 illustrates an example method 300 of delivering goods. A step 310 comprises placing a good in a chamber defined by a container. Another step 312 comprises placing a cold pack in the chamber, the cold pack according to an embodiment. In an example, the cold pack comprises a main body defining an inner chamber and a phase changeable medium disposed in the inner chamber, the phase changeable medium comprising a peptide. Another step 314 comprises closing the container to contain the good and the cold pack in the chamber defined by the container. Another step 316 comprises transporting the container from a first location to a second location that is different from the first location.

Figure 8:
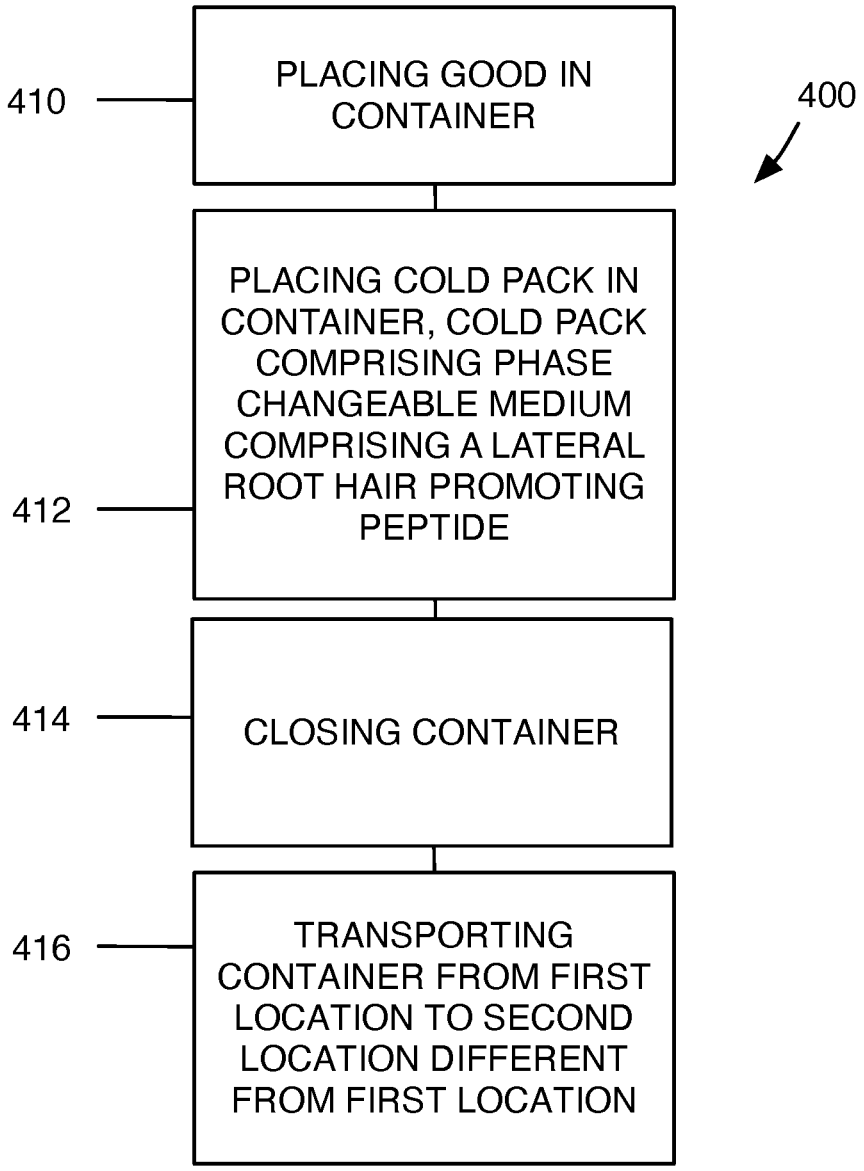
FIG. 8 is a flowchart illustration of another example method of delivering goods.

FIG. 8 illustrates another example method 400 of delivering goods. A step 410 comprises placing a good in a chamber defined by a container. Another step 412 comprises placing a cold pack in the chamber, the cold pack according to an embodiment. In an example, the cold pack comprises a main body defining an inner chamber and a phase changeable medium disposed in the inner chamber, the phase changeable medium comprising a lateral root hair promoting peptide. In examples, the lateral root hair promoting peptide has the amino acid sequence set forth in SEQ ID NO. 1. Another step 414 comprises closing the container to contain the good and the cold pack in the chamber defined by the container. Another step 416 comprises transporting the container from a first location to a second location that is different from the first location.

Figure 9:
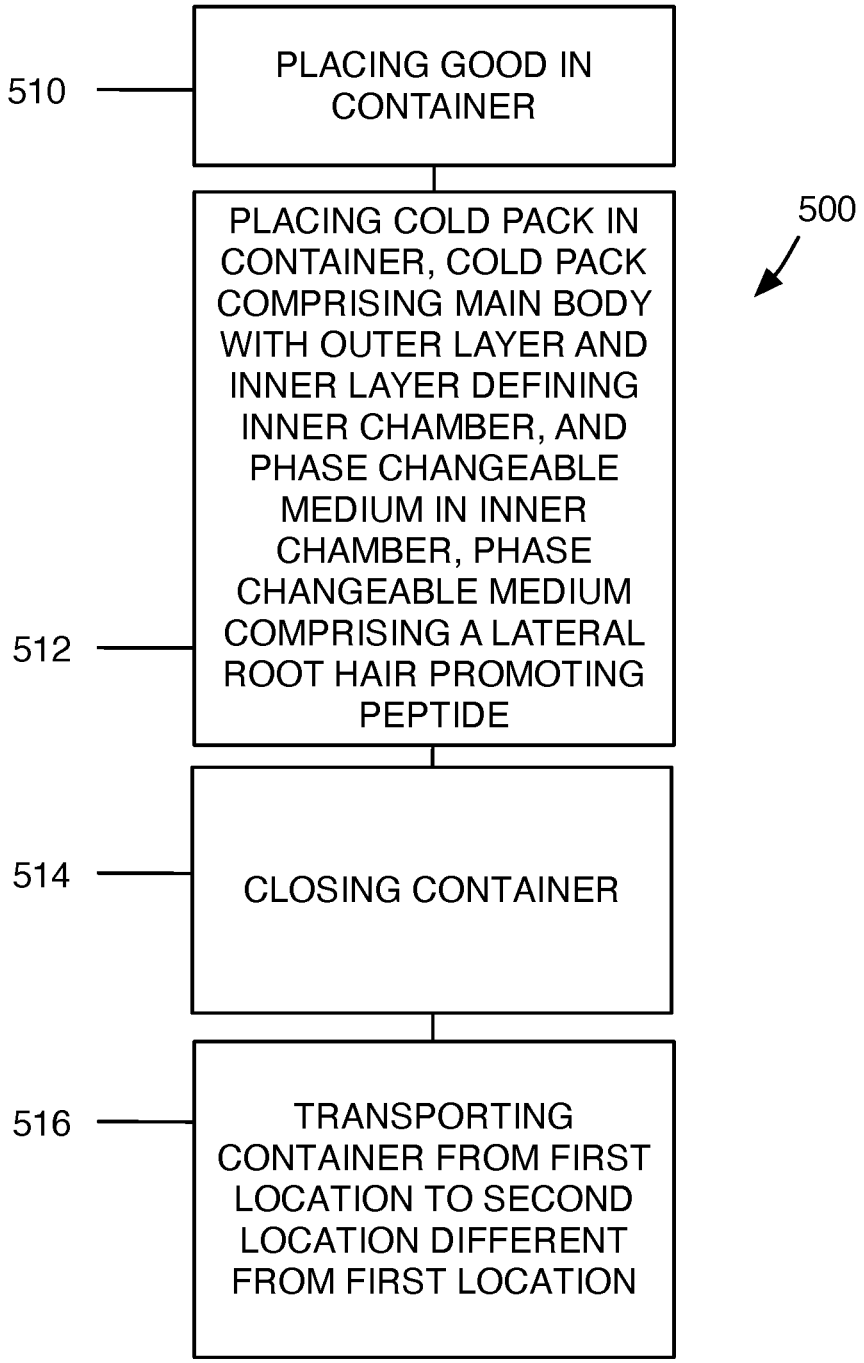
FIG. 9 is a flowchart illustration of another example method of delivering goods.

FIG. 9 illustrates another example method 500 of delivering goods. A step 510 comprises placing a good in a chamber defined by a container. Another step 512 comprises placing a cold pack in the chamber, the cold pack according to an embodiment. In an example, the cold pack comprises a main body defining an outer layer and an inner layer defining an inner chamber, a phase changeable medium disposed in the inner chamber, the phase changeable medium comprising a lateral root hair promoting peptide. In examples, the lateral root hair promoting peptide has the amino acid sequence set forth in SEQ ID NO. 1. Another step 514 comprises closing the container to contain the good and the cold pack in the chamber defined by the container. Another step 516 comprises transporting the container from a first location to a second location that is different from the first location.

Those with ordinary skill in the art will appreciate that various modifications and alternatives for the described and illustrated examples can be developed in light of the overall teachings of the disclosure, and that the various elements and features of one example described and illustrated herein can be combined with various elements and features of another example without departing from the scope of the invention. Accordingly, the examples disclosed herein have been selected by the inventors simply to describe and illustrate examples of the invention and are not intended to limit the scope of the invention or its protection, which is to be given the full breadth of the appended claims and all equivalents thereof.

SEQUENCE LISTING

```
Sequence total quantity: 1
SEQ ID NO: 1            moltype = AA  length = 12
FEATURE                 Location/Qualifiers
source                  1..12
                        mol_type = protein
                        organism = Glycine max
SEQUENCE: 1
GGIRAAPTGN ER                                                    12
```

We claim:

1. A cold pack for maintaining the temperature of goods within a range of temperatures during transport, the cold pack comprising:

a main body defining an inner chamber; and a phase changeable medium disposed in the inner chamber, the phase changeable medium comprising a polymer and a peptide disposed in the polymer.

2. The cold pack of claim 1, wherein the peptide comprises a lateral root hair promoting peptide.

3. The cold pack of claim 2, wherein the peptide has the amino acid sequence set forth in SEQ ID NO. 1.

4. The cold pack of claim 1, wherein the peptide is a component of a peptide-containing composition.

5. The cold pack of claim 4, wherein the peptide-containing composition comprises a plant-derived protein hydrolysate.

6. The cold pack of claim 5, wherein the peptide-containing composition comprises a legume-derived protein hydrolysate.

7. The cold pack of claim 1, wherein the polymer comprises an organic polymer.

8. The cold pack of claim 7, wherein the polymer comprises an organic superabsorbent polymer.

9. The cold pack of claim 8, wherein the polymer comprises potassium polyacrylate.

10. The cold pack of claim 1, wherein the main body has a first outer surface, a second outer surface, a first edge, a second edge, a third edge, a fourth edge, and an intermediate seam, and the first outer surface is connected to the second outer surface by the first edge, the second edge, the third edge, the fourth edge, and the intermediate seam.

11. The cold pack of claim 10, wherein the first outer surface, the second outer surface, the first edge, the second edge, the third edge, the fourth edge, and the intermediate seam define a boundary of the inner chamber.

12. A cold pack for maintaining the temperature of goods within a range of temperatures during transport, the cold pack comprising:

a main body defining an inner chamber;

a phase changeable medium disposed in the inner chamber, the phase changeable medium comprising an organic polymer and a peptide-containing composition disposed in the organic polymer.

13. The cold pack of claim 12, wherein the peptide-containing composition comprises a plant-derived protein hydrolysate.

14. The cold pack of claim 13, wherein the peptide-containing composition comprises a legume-derived protein hydrolysate.

15. The cold pack of claim 12, wherein the peptide-containing composition comprises a lateral root hair promoting peptide.

16. The cold pack of claim 15, wherein the lateral root hair promoting peptide has the amino acid sequence set forth in SEQ ID NO. 1.

17. The cold pack of claim 12, wherein the organic polymer comprises an organic superabsorbent polymer.

* * * * *